United States Patent [19]

Rohmfeld

[11] B 4,000,433

[45] Dec. 28, 1976

[54] X-RAY TUBE FOR MICROSTRUCTURE ANALYSIS

[75] Inventor: Josef Rohmfeld, Erlangen, Germany

[73] Assignee: Siemens Aktiengesellschaft, Berlin & Munich, Germany

[22] Filed: Nov. 4, 1974

[21] Appl. No.: 520,884

[44] Published under the second Trial Voluntary Protest Program on March 16, 1976 as document No. B 520,884.

[30] Foreign Application Priority Data

Nov. 19, 1973 Germany ..... 2357687

[52] U.S. Cl. ..... 313/330; 313/55

[51] Int. Cl.[2] ..... H01J 35/08

[58] Field of Search ..... 313/330, 55, 59

[56] References Cited

UNITED STATES PATENTS

| | | | |
|---|---|---|---|
| 1,132,442 | 3/1915 | Clawson | 313/330 X |
| 2,090,636 | 8/1937 | Olshevsky | 313/330 X |
| 2,250,322 | 7/1941 | Atlee | 313/330 X |

FOREIGN PATENTS OR APPLICATIONS

| | | | |
|---|---|---|---|
| 1,063,386 | 9/1963 | United Kingdom | 313/330 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

An X-ray tube having a copper anode utilized in microstructure analysis. The X-ray tube, on the one hand, facilitates obtaining monochromatically employable X-rays, in which, on the other hand, the extent of reduction of the radiation output is only extremely minute, by providing an X-ray tube which has a copper anode wherein the copper located at least at the focal point is alloyed with a percentage of silver.

3 Claims, 1 Drawing Figure

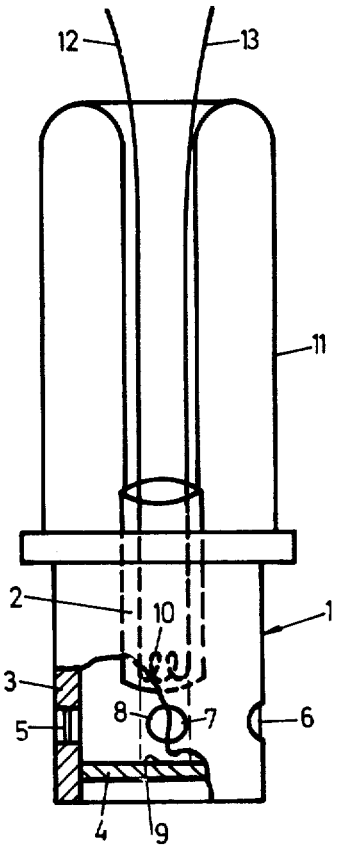
12
13
11
2
10
1
3
8
7
6
5
4
9

X-RAY TUBE FOR MICROSTRUCTURE ANALYSIS

FIELD OF THE INVENTION

The present invention relates to an X-ray tube having a copper anode utilized in microstructure analysis.

DISCUSSION OF THE PRIOR ART

X-ray tubes of this type, having copper anodes are, as known, employed in the microstructure examination of materials, in order to produce monochromatic X-rays, as utilized in microstructure analysis. This, as known, provides the ability of examining the internal structure of materials.

In the above-indicated analytical methods there are preferably employed monochromatic X-rays, in order to satisfy the Bragg-type reflective condition $n \cdot \lambda = 2d \cdot \sin \phi$; in which $n$ is the ordinal number of the spectrum, $\lambda$ the X-ray wavelength, $d$ the lattice constants of the material being examined and $\phi$ the angle of reflection. Herewith, as a rule, it is desired to possibly provide the same relationships for all measurements, meaning, a particularly constant radiation output for the X-ray tube. Only then are there attainable equal or, respectively, comparative measurements. In the known tubes which have copper anodes, after already 500 operating hours there must be expected a 3.5% drop-off or reduction in the radiation output.

SUMMARY OF THE INVENTION

Accordingly, it is an object of the present invention to provide X-ray tubes having copper anodes from which, on the one hand, there are obtained monchromatically employable X-rays, however, in which, on the other hand, the extent of reduction of the radiation output is only extremely minute.

Inventively, the foregoing object is achieved by providing an X-ray tube employable for microstructure analysis, which has a copper anode wherein the copper located at the focal point is alloyed with a percentage of silver.

Since at least the copper which is located at the focal point of the X-ray tube is alloyed with $5 \cdot 10^{-3}$ up to $5 \cdot 10^{-1}$ percentage by weight of silver, and particularly 0.1%, there is obtained an anode which for the same loading, in contrast with known copper anodes, still does not evidence any reduction after 500 hours. On the other hand, due to the only insignificant contamination of the copper with silver, there does not occur any significant radiation of silver which would influence the monochromatically operating radiation of the copper.

There are already known X-ray tubes whose anodes are constituted of alloyed metals, for instance such, whose anode material consists of tungsten, to which there are alloyed difficultly fusible metals. Such X-ray tubes are employed only in coarse X-ray structural analysis and, in particular, in the medical X-ray diagnostic technology. In those instances there is no particular concern with respect to the spectral purity of the X-rays, but rather with respect to their intensity. It is immaterial when different metals contribute to the formation of the X-rays.

Also in the microstructure analysis there are currently known X-ray tubes in which there are employed alloyed anodes. Herein, however, the materials, meaning, the alloying elements are so selected that their inherently characteristic radiations are also employable. Consequently, as a rule, they are thus provided in mutually comparable quantities in the alloy so that for each component there is achieved a sufficient intensity.

During experiments which lead to the present invention and which were carried out for the purpose of manufacturing spectrally pure X-rays, by employing pure anode materials, there has been determined that an improvement can be achieved in the context of obtaining a reduction in the drop off of the radiation output through the additions of insignificant quantities of iron or cobalt, or respectively, chromium. These additions in distinction with silver lead, however, to important disadvantages. The required additions either reduce the degree of spectral purity of the generated X-rays by more than 0.5% or they influence other essential properties of the material, such as chrome, which adversely affect the fusibility of the anodes.

In comparison therewith, in a surprising manner, through an alloy with silver already at the mentioned alloying of $5 \cdot 10^{-3}$ to $5 \cdot 10^{-1}$ percentage by weight, there is obtained an improvement in context of an increase of the life expectancy of the anodes, without causing any detrimental contamination in the spectral purity of the generated X-rays. Namely, with an increasing addition of silver, there is attainable a further reduction in the recrystallization temperature of the copper, and thereby an improvement of the life expectancy of the anodes. However, the intensity of the generated X-rays which are characteristic for silver becomes so strong, that they are no longer negligible. In the inventive range for the addition of silver, there has been ascertained as an optimum compromise with regard to effecting an increase in the life expectancy of the anodes, a range of $5 \cdot 10^{-2}$ to $2 \cdot 10^{-1}$. Copper alloys, whose silver contents lie within the above-mentioned range, may be commercially obtained as industrial products.

BRIEF DESCRIPTION OF THE DRAWING

Reference may now be had to the following detailed description of an exemplary embodiment of the invention, taken in conjunction with the single FIGURE of the accompanying drawing, showing an X-ray tube anode in a schematic and partly sectioned manner.

DETAILED DESCRIPTION

The illustrated X-ray tube for microstructure analysis consists of an anode head 1 and a cathode arrangement 2. The anode head 1, on the one side, encompasses the metallic sleeve 3 and the actual anode insert 4 which, in accordance with the invention, consists of copper, having silver alloyed therewith in the amount of 0.1 percent by weight. In the wall of the sleeve there are formed windows 5 through 8 for the outlet of the X-rays. The windows, in a known manner, consist of thin beryllium sheets. The X-rays formed at the focal point surface 9 can then exit through the windows 7 and 8 in a direction in parallel with the length of filament coil 10 of the cathode arrangement 2 located along the longitudinal axis of the focal point 9 or, respectively, transversely relative thereto through windows 5 and 6 of the vacuum piston of the tube. The latter is completed by means of a glass element 11 which insulates the cathode arrangement, and which is mounted in vacuum-tight manner on the anode head 1.

For the generation of X-rays, there is applied a filament voltage for the glow filament coil 10 between infeed conduits 12 and 13. In addition, between one of the conduits 12 and 13 and the anode head 1 there is applied a high-voltage of 20 to 60 kV, so that the electrons which emanate from the glow cathode are accelerated against the focal point surface 9 as shown in a chain-dotted beam. X-rays may then there be resolved which exit through windows 5 through 8, and which in a known manner are then applicable to X-ray microstructure analysis.

While there has been shown what is considered to be the preferred embodiment of the invention, it will be obvious that modifications may be made which come within the scope of the disclosure of the specification.

What is claimed is:

1. An anode for an X-ray tube for microstructure analysis utilized in the production of monochromatically-employable copper-X-radiation, comprising a copper anode, said copper anode having the copper of at least the portion of said anode located at the focal point of the X-rays alloyed with silver in amount of about $5 \cdot 10^{-3}$ to $5 \cdot 10^{-1}$ of silver in percent by weight.

2. An X-ray tube as claimed in claim 1, said silver quantity being in the range of $5 \cdot 10^{-2}$ to $2 \cdot 10^{-1}$.

3. An X-ray tube as claimed in claim 1, said copper having 0.1 silver in percent by weight alloyed thereto.

* * * * *